United States Patent [19]

Rogers

[11] 4,285,475

[45] Aug. 25, 1981

[54] MECHANICAL FEED-UP OF WEB MATERIAL ON A RECOILER

[76] Inventor: John W. Rogers, 22175 Douglas Rd., Shaker Heights, Ohio 44122

[21] Appl. No.: 129,967

[22] Filed: Mar. 13, 1980

[51] Int. Cl.[3] ..... B65H 15/02; B21C 17/10

[52] U.S. Cl. ..... 242/56.2; 242/78.3

[58] Field of Search ..... 242/78.3, 56.2, 56.3, 242/56.4, 56.5, 56.6, 56.7, 78.6, 78.8

[56] References Cited

U.S. PATENT DOCUMENTS

| | | | |
|---|---|---|---|
| 3,461,703 | 8/1969 | Runney | 242/78.8 |
| 4,170,691 | 10/1979 | Rogers | 242/56.2 |
| 4,171,080 | 10/1979 | Rogers | 242/56.2 |
| 4,173,313 | 11/1979 | Rogers | 242/56.2 |
| 4,201,352 | 5/1980 | Modachy | 242/56.2 |

*Primary Examiner*—Edward J. McCarthy
*Attorney, Agent, or Firm*—John F. Carney

[57] ABSTRACT

Method and apparatus are described by means of which the slitting head in a slitting line for severing sheet metal web material into strips is utilized to transfer the leading end of the web material from the uncoiler to the recoiler for attachment thereto during the feed-up operation. The invention enables the concerned operation to be performed more safely in reduced time and with less effort and manpower than heretofore.

20 Claims, 6 Drawing Figures

MECHANICAL FEED-UP OF WEB MATERIAL ON A RECOILER

BACKGROUND OF THE INVENTION

The present invention relates to slitting lines in which an elongated web of material, such as sheet metal in coil form, is unwound from an uncoiler, slit into multiple strips by rotary slitting knives and coiled on a recoiler. In particular, the invention pertains to a method of and apparatus for conveniently feeding-up the web material by transferring its leading end from the uncoiler, through the slitter head that contains the slitting knives to the recoiler mandrel for attachment thereto.

In the feed-up of a conventional slitting line at least two, and possibly more, workmen are required, depending upon the gauge of the material being slit, the width of the web, and the number of strips being produced. The task is both arduous and hazardous in that the leading end of the web must be manually hauled from the uncoiler either with or without an assist from the uncoiler drive and inserted between pinch rolls disposed on the upstream side of the slitter knives. Following this, the pinch rolls may be driven to move the web toward the slitter knives with workmen guiding its entry into the nip of the slitter knives. The knives are operated to slit the web thereby to initiate formation of the strips which pass through to the downstream side of the slitter head. Workmen then must take each individual strip and carry it to the recoiler where they are each threaded over the overarm separators before their leading ends are manually inserted into the gripper slot of the recoiler mandrel. The time and manpower required to perform the operation is significant.

It is to the amelioration of this problem therefore that the present invention is directed.

SUMMARY OF THE INVENTION

Recent developments in the sheet metal slitting art have produced a radical change from conventional slitting practice in that the strips made in an elongated web are provided with frangible tabs which cause the strips to remain interconnected at least during the winding of the product on the recoiler. This form of slitting practice and the product produced thereby are described in U.S. Pat. Nos. 4,155,238, 4,170,691, 4,171,080 and 4,173,313 by John W. Rogers and granted May 22, 1979, Oct. 9, 1979, Oct. 16, 1979 and Nov. 6, 1979, respectively. One of the more significant advantages derived from this method of slitting is the ability to reduce the length of the slitting line. Utilizing this characteristic of the improved slitting process, the present invention provides a means for significantly reducing the labor and time required for the feed-up operation in a sheet metal slitting line by replacing much of the manual effort heretofore required by mechanical effort. The result is a feed-up operation that is less hazardous to the workman and more efficient in terms of the costs heretofore attributed to this operation.

Accordingly, the present invention provides, in a web slitting line, including an uncoiler, a slitter head containing rotary slitting knives and a recoiler, a coil of web material carried by said uncoiler, said web material being adapted to extend through said slitter and be cut into strips, the method of feeding said web material from said uncoiler to said recoiler comprising the steps of moving said slitter head to a position closely adjacent said uncoiler, unwinding said web material from said uncoiler to place the leading end thereof at the nip of said slitting knives, engaging said web leading end by said slitting knives, moving said slitter head to a position closely adjacent said recoiler, operating said knives to move the leading end of said web into engagement with said recoiler, and attaching said web leading end to said recoiler.

The present invention also provides in a web slitting line containing an uncoiler, a coil of web material carried by said uncoiler, a recoiler spaced from said uncoiler, and a slitter head positioned intermediate said uncoiler and said recoiler and containing rotary slitting knives for slitting said web into multiple strips, the improvement comprising means for moving said slitter head from a position closely adjacent said uncoiler to a position closely adjacent said recoiler.

For a better understanding of the invention, its operating advantages and the specific objectives obtained by its use, reference should be made to the accompanying drawings and description which relate to a preferred embodiment thereof.

DESCRIPTION OF A PREFERRED EMBODIMENT OF THE INVENTION

Figure 5:
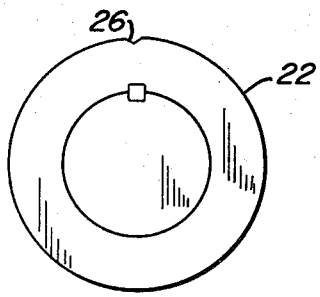
FIG. 5 is an enlarged view of a typical slitter knife employed in the slitter head of FIGS. 1 and 2.

In the drawings there is shown a slitting line 10 consisting of an uncoiler 12, a recoiler 14 longitudinally spaced from the uncoiler and a slitter mechanism 16 interposed therebetween. The slitter mechanism includes a slitter head 18 containing pinch rolls 20 and pairs of opposed rotary slitting knives 22 and knock-down rolls 24 for slitting an elongated sheet metal web. The slitting knives 22 are typically notched as at 26 (FIG. 5) to slit the web in the manner described in detail in U.S. Pat No. 4,155,238, which manner of slitting will be more fully described hereinafter to an extent sufficient for an understanding of the present invention.

Figure 3:
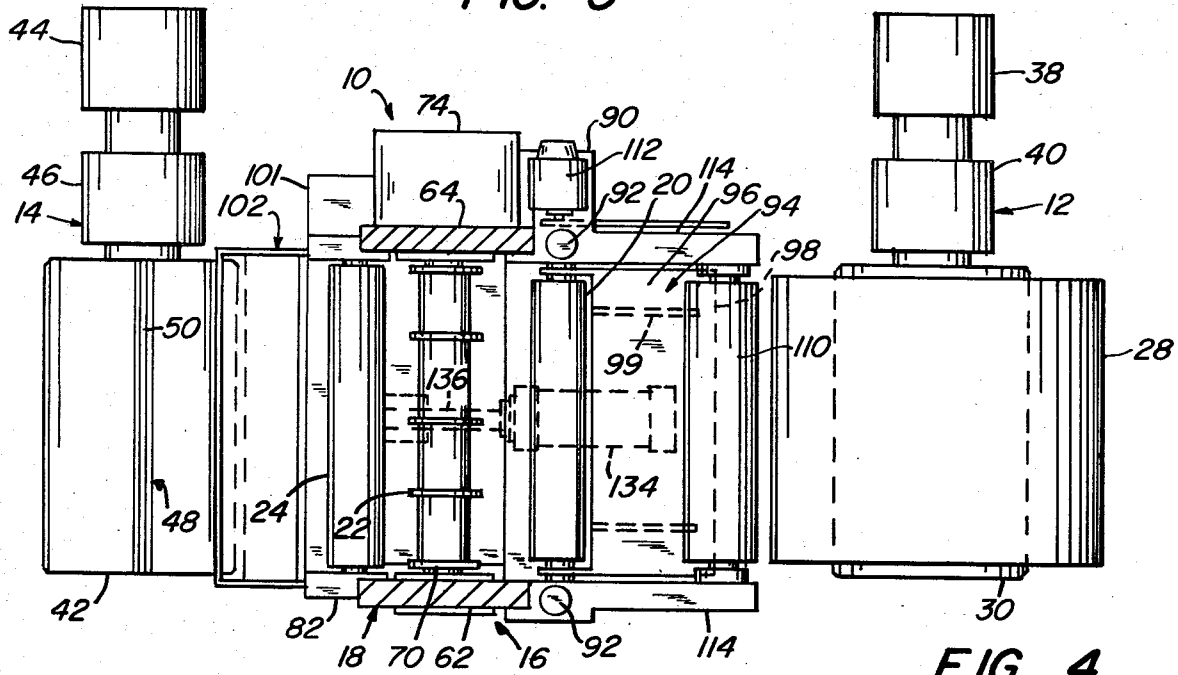
FIG. 3 is a plan view, partly in section, of the apparatus shown in a position intermediate those of FIGS. 1 and 2.
Figure 4:
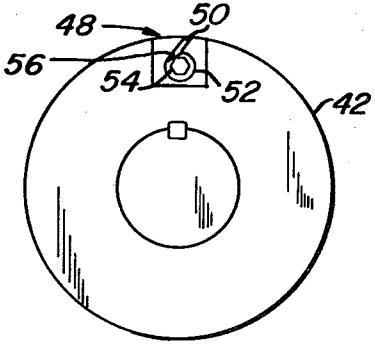
FIG. 4 is an elevational view of the recoiler mandrel of FIGS. 1 and 2 somewhat enlarged to illustrate the web gripper mechanism.
Figure 6:
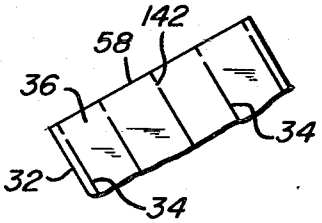
FIG. 6 is a view of the leading end of the web illustrating its condition prior to attachment to the recoiler mandrel.

A coil 28 of wound sheet metal is positioned on the mandrel 30 of uncoiler 12 and arranged to be conducted through the slitting head 18 where the web indicated as 32 in FIG. 6 is continuously slit to produce parting lines 34 defining multiple strips 36 prior to winding on the recoiler 14. The uncoiler mandrel 30, as shown, is rotatably driven by a motor 38 through appropriate reduction gearing 40, all as is well known in the art. The recoiler 14, also of well-known construction comprises a horizontally disposed mandrel 42 that is driven by drive motor 44 through reduction gearing 46. With particular reference to FIGS. 3 and 4, the recoiler mandrel 42 is provided on its external surface with a gripper device 48 that includes an elongated slot 50 extending parallel to the mandrel axis and a gripper shaft 52 operated by a tool-receiving head 54. The shaft 52 contains a chordal flat 56 that is caused, upon rotation of the shaft, to engage and hold the leading end 58 of web 32 fast to the mandrel 42.

The slitting head 18 comprises an open, generally rectangular frame structure having a bottom 58, a top 60 and opposed side members 62 and 64. The side members 62 and 64 each contain a vertically elongated opening 66 defining a guideway for slidable bearing blocks 68 that journal the opposite ends of drive shafts 70 and 72 that carry the slitting knives 22. The shafts 70 and 72 are operatively connected at one end to an appropriate drive 74 mounted on the adjacent side member. Fluid-operated cylinders 76 attached over the top of the respective side members 62 and 64 are operative through piston rods 78 for adjusting the spacing between the drive shafts 70 and 72 and thereby between the cutting edges of the opposed knives 22 in each pair.

The frame side members 62 and 64 each attach oppositely-spaced extension plates 80 and 82, the former pair extending rearwardly of the slitting head 18 and the latter extending forwardly thereof. Extension plates 80 each contain an elongated opening 84 for slidably mounting bearing blocks 86 that journal the ends of pinch rolls 20. The pinch rolls 20 may be selectively driven by appropriate gearing indicated generally at 90 from the slitter drive 74. Quick acting cylinders 92 are positioned atop the plates 80 and connect with the upper bearing blocks 86 to raise the upper pinch roll upon demand.

A peeler 94 is pivotally mounted to the slitting head and extends transversely across the path traversed by the web 32 prior to its entering the slitting head 18. As shown in the drawings, the peeler 94 in the described arrangement is formed by an elongated plate 96 having a knife edge 98 at its free end and gussets 99 at opposite sides, which gussets contain slightly oversized openings to permit the plate to be pivotally collared about the shaft of the lower pinch roll. A stop bar 100 extends between the extension plates 80 and serves to limit the extent of pivotal movement of the peeler downwardly to the position shown in FIG. 2.

Extension plates 82 which extend forwardly from each side member of the frame of slitting head 18 contain vertically spaced openings to receive bearings for journalling the shafts of the knock-down rolls 24. The knock-down rolls are driven by appropriate drive means, indicated generally as 101 in FIG. 3, off the slitter drive 74. The drive means 101 includes an overrunning clutch (not shown) whereby the knock-down rolls 24 are permitted to rotate freely when movement of the web 32 is undertaken by the recoiler 14 as hereinafter more fully explained.

Figure 2:
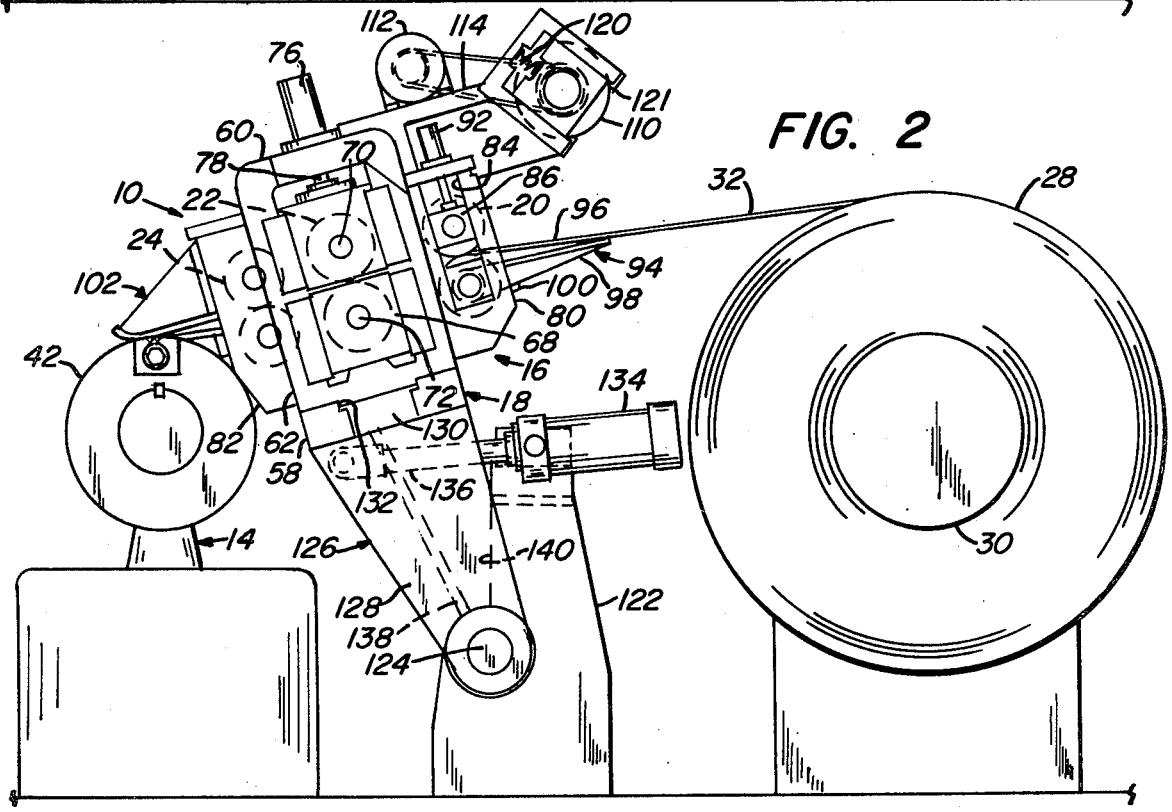

The extension plates 82 also mount a web guide 102 comprising oppositely spaced formed plates 104 and 106 that serve to guide the leading end of web 32 into the gripper slot 50 on the recoiler mandrel 42. As shown in FIG. 2, the plates 104 and 106 are arranged to conform generally to the external surface of the mandrel 42 and a bearing pad 108 is associated with lower plate 106 to permit the guide 102 to bear on the mandrel without gauging or otherwise damaging the surface thereof.

A press roll 110 driven by motor 112 extends forwardly of the upper portion of the slitting head 18. The roll 110 and motor 112 are mounted from oppositely spaced arms 114 attached to the slitting head frame. As shown, the ends of the press roll 110 are journalled in bearing blocks 116 that are slidable in ways 118 and that are biased downwardly by springs 120. Stops 121 serve to retain the bearing blocks 116 in the ways 118.

The slitting head 18 is supported for pivotal movement between the uncoiler 12 and recoiler 14 upon a pedestal 12 that contains pivot shaft 124. A pivot support 126 having arms 128 that straddle the pedestal 122 and an attachment key 130 extending between and uniting the arms serves to attach the slitting head. As shown, key 130 is adapted to be slidably received in a keyway 132 formed in the bottom 58 of the slitting head thereby facilitating removal and replacement of heads having various slitter configurations. Set screws (not shown) or other appropriate locking mechanism serve to attach the slitting head to the key.

Pivotal movement is imparted to the assembly by a fluid operated cylinder 134 whose piston rod 136 is pin-connected to a clevis on the pivot support 126. The extent of pivotal movement of the slitter head support can be limited in the forward direction by provision of a limit plate 138 that extends between the arms 128 and that bears on the rear face 140 of the pedestal 122.

Figure 1:
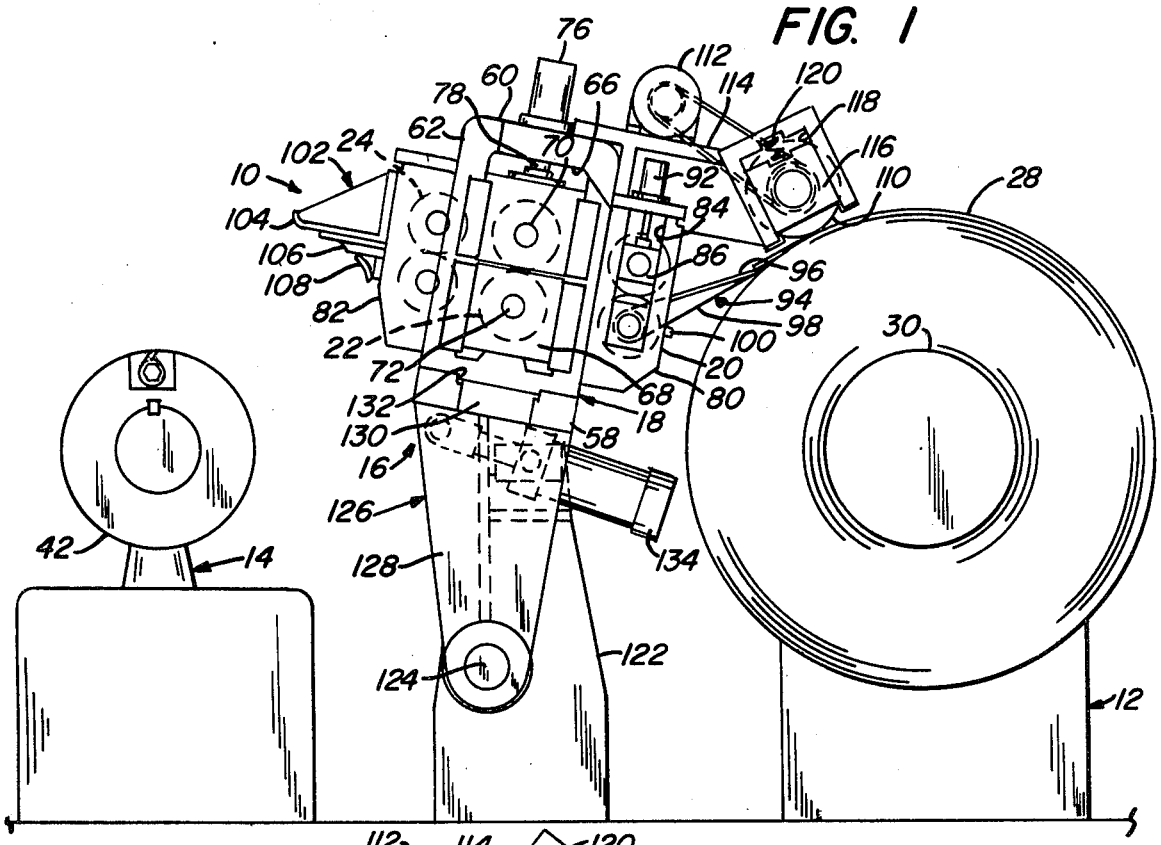
FIGS. 1 and 2 are somewhat schematic elevational views, partly in section, illustrating a slitter head mechanism according to the present invention in its operative positions adjacent the uncoiler and the recoiler respectively in a slitting line.

The hereindescribed apparatus is adapted to mechanically transfer the leading end of the web 32 of sheet metal being slit from the uncoiler 12 to the recoiler 14 for attachment to the recoiler mandrel 42 as part of the feed-up operation that is a necessary prerequisite to any continuous slitting operation. This function is accomplished as follows. With a coil 28 of sheet metal web material mounted on the mandrel 30 of uncoiler 12 fluid cylinder 134 is actuated to move the slitting head 18 forwardly until stopped by abutment of the limit plate 138 with the rear face 140 of the pedestal 122, as shown in FIG. 1. This action places the free edge of the peeler 94 in bearing engagement on the surface of the coil 28 just rearwardly of the leading end 58 of the outermost wrap and the press roll 110 in engagement with the coil just forwardly thereof. The slitter mechanism drive 74, including the press roll motor 112 and the drive motor 38 of the uncoiler are actuated thereby causing the leading end 58 of the web to unwrap from the coil and move across the upper surface of the peeler plate 96 toward the nip of the pinch rolls 20. As the web approaches the pinch rolls 88, cylinders 92 are actuated to momentarily raise the upper roll permitting the web to pass between the rolls. When the upper pinch roll returns to its former position it engages the web and thereafter undertakes the function of drawing the web through the slitting head, with the press roll 110 acting to provide back pressure on the web, thus preventing any retrograde movement in the web that would impede its movement through the slitting head 18.

As the web enters the nip of the slitting knives 22 slitting of the web into strips 36 (FIG. 6) commences; however, the notches 26 (FIG. 5) in the slitting knives having been previously set to engage the web as near as practicable to its leading end 58 tabs, indicated schematically in FIG. 6 as 142, are produced in the parting lines 34 to retain the strips 36 in side-by-side relation as the now-slit web proceeds through the knock-down rolls 24. Knock-down rolls 24 return the slit strips to coplanar relation while retaining the integrity of the tabs 142, all as described in detail in U.S. Pat. Nos. 4,155,238, 4,170,691 and 4,173,313. The web 32 is extended through the opening between the guide plates 104, 106 with an additional assist from the driving force of the knock-down rolls 24 until its leading end 58 extends sufficiently beyond the end of the opening between the plates 104, 106 to permit insertion of the web into the gripper mechanism 48 in the mandrel 42 of recoiler 14. At this point the operation of the slitter and uncoiler drive mechanisms is terminated and the fluid cylinder 134 actuated to extend the piston rod 136 thereby causing the slitting head 18 with the retained web to pivot to its rearwardmost position (FIG. 2) to place the guide plates 104, 106 into bearing engagement on the recoiler mandrel 42 and the leading end 58 of the web 32 into the slot 50 of the recoiler gripper device 48; the stoke of the piston rod 136 being of predetermined length to place the web into the slot 50 which has previously been positioned into a web-receiving position. Thereafter, a workman rotates the gripper shaft 52 to secure the web on the recoiler mandrel 42 and the slitting line is ready for actuation of the recoiler drive motor 44 and commencement of the slitting operation.

In the preferred arrangement it is contemplated that the fluid cylinder 134 will be continuously operated to slowly pivot the slitter head assembly forwardly as the coil on the recoiler mandrel is built up.

It will be understood that various changes in the details, materials and arrangements of parts which have been herein described and illustrated in order to explain the nature of the invention, may be made by those skilled in the art within the principle and scope of the invention as expressed in the appended claims.

I claim:

1. In a web slitting line including an uncoiler, a slitter head containing rotary slitting knives and a recoiler, a coil of web material carried by said uncoiler, said web material being adapted to extend through said slitter and be cut into strips, the method of feeding said web material from said uncoiler to said recoiler comprising the steps of:

(a) moving said slitter head to a position closely adjacent said uncoiler;
(b) unwinding said web material from said uncoiler to place the leading end thereof at the nip of said slitting knives;
(c) engaging said web leading end by said slitting knives;
(d) moving said slitter head to a position closely adjacent said recoiler;
(e) operate said knives to move the leading end of said web into engagement with said recoiler; and
(f) attaching said web leading end to said recoiler.

2. The method of claim 1 in which said slitting knives are operated to move said web with respect to said slitter head while said slitter head is moved toward said recoiler.

3. The method of claim 2 in which said slitter head includes knock-down rolls for engaging said web material on the downstream side of said slitting knives and including the step of driving said knock-down rolls while said slitter head is moved toward said recoiler.

4. The method of any one of claims 1 to 3 including the step of partially shearing said web material adjacent the leading end thereof to create a union between adjacent slit strips thereat.

5. In a web slitting line containing an uncoiler, a coil of web material carried by said uncoiler, a recoiler spaced from said uncoiler, and a slitter head positioned intermediate said uncoiler and said recoiler and containing rotary slitting knives for slitting said web into multiple strips, the improvement comprising means for moving said slitter head from a position closely adjacent said uncoiler to a position closely adjacent said recoiler.

6. The improvement of claim 5 in which said slitting head is contiguous with said uncoiler and said recoiler in the respective positions.

7. The improvement of claim 5 in which said slitter head moving means comprises:

(a) a stationary base;
(b) a pivot arm mounting said slitter head at one end and having its other end pivotally attached to said base; and
(c) drive means connected to said pivot arm for moving said slitter head alternately to positions adjacent said uncoiler and said recoiler.

8. The improvement as recited in any one of claims 5 to 7 in which said slitter head includes means for peeling the outermost wrap of web material from said coil and for guiding the leading end thereof into engagement with said slitting knives.

9. The improvement as recited in claim 8 in which said peeling and guiding means comprises a blade pivotally connected at one end to said slitter head and extending transversely of the path of movement of said web material, said blade having a substantially wedge-shaped free end for engagement with the surface of said coil.

10. The improvement as recited in any one of claims 5 to 7 in which said slitter head includes means downstream of said slitting knives in the web-movement sense for guiding the leading end of said web material into connected engagement with said uncoiler.

11. The improvement as recited in claim 10 in which said guiding means comprises a pair of oppositely spaced plates fixedly attached to said slitter head and extending transversely of the path of movement of said web material, the leading end of said plates being adapted to bear on the surface of said recoiler to guide said web material into connected engagement therewith.

12. The improvement as recited in any one of claims 5 to 7 including means for retaining the web material exiting said slitting knives in transverse connected relation at least adjacent the leading end of said web material.

13. The improvement as recited in claim 12 in which said web material retaining means comprises means associated with said slitting knives for creating a tab of web material bridging the interstice between the slit material.

14. The improvement as recited in claim 13 in which at least one of said slitting knives in each pair contains a relief in its cutting edge for forming said tab.

15. A slitter head adapted for movement between an uncoiler and a recoiler in a slitting line to mechanically feed-up the web being slit onto the recoiler mandrel comprising:

(a) a frame;
(b) opposed pairs of rotary knives mounted on said frame for slitting web material passed therebetween;
(c) a pair of opposed pinch rolls on said frame forwardly adjacent said rotary knives adapted to drive said web material thereto; and
(d) a peeling blade pivotally attached to said frame having a free end adapted to strip the outermost wrap of web material from said uncoiler when said frame is moved to a position adjacent thereto.

16. The slitter head as recited in claim 15 including means on said frame for momentarily spreading said pinch rolls for reception of web material stripped by said peeling blade.

17. The slitter head as recited in claim 16 including a mechanically driven press roll mounted on said frame and adapted to engage the exterior of said outermost wrap forwardly of the point of engagement of said peeler blade.

18. The slitter head as recited in claim 17 including means forming a web guide mounted on said frame rearwardly of said rotary knives, said web guide being formed for bearing engagement on said recoiler mandrel when said frame is moved to a position adjacent thereto.

19. The slitter head as recited in claim 18 including means for moving the same alternately between said uncoiler and said recoiler.

20. The slitter head as recited in claim 19 in which said moving means comprises:

(a) a base fixedly positioned intermediate said uncoiler and said recoiler;

(b) a pivot arm mounting said slitter head at one end and having its other end pivotally attached to said base; and (c) means connected to said pivot arm for moving said slitter head alternately to positions adjacent said uncoiler and said recoiler.

* * * * *

UNITED STATES PATENT AND TRADEMARK OFFICE

CERTIFICATE OF CORRECTION

PATENT NO. : 4,285,475

DATED : August 25, 1981

INVENTOR(S) : John W. Rogers

It is certified that error appears in the above-identified patent and that said Letters Patent are hereby corrected as shown below:

Column 4, line 7, after "pedestal", change "12" to -- 122 --.

Column 5, line 11, change "stoke" to -- stroke --.

Signed and Sealed this

*Ninth* Day of *March 1982*

[SEAL]

*Attest:*

GERALD J. MOSSINGHOFF

*Attesting Officer*

*Commissioner of Patents and Trademarks*